US009879412B2

(12) United States Patent
Miyagawa et al.

(10) Patent No.: US 9,879,412 B2
(45) Date of Patent: Jan. 30, 2018

(54) PIN JOINT TYPE STRUCTURAL MEMBER MADE OF DOUBLE STEEL PIPE FOR RESTRAINING BUCKLING THEREOF

(71) Applicants: JFE Civil Engineering & Construction Corp., Tokyo (JP); JFE Steel Corporation, Tokyo (JP)

(72) Inventors: Kazuaki Miyagawa, Tokyo (JP); Wataru Kitamura, Tokyo (JP); Tomohiro Kinoshita, Tokyo (JP); Takumi Ishii, Tokyo (JP)

(73) Assignees: JFE CIVIL ENGINEERING & CONSTRUCTION CORPORATION (JP); JFE STEEL CORPORATION (JP)

( * ) Notice: Subject to any disclaimer, the term of this patent is extended or adjusted under 35 U.S.C. 154(b) by 272 days.

(21) Appl. No.: 14/418,177

(22) PCT Filed: Jul. 30, 2013

(86) PCT No.: PCT/JP2013/070549
§ 371 (c)(1),
(2) Date: Jan. 29, 2015

(87) PCT Pub. No.: WO2014/021297
PCT Pub. Date: Feb. 6, 2014

(65) Prior Publication Data

US 2015/0159361 A1 Jun. 11, 2015

(30) Foreign Application Priority Data

Jul. 30, 2012 (JP) ..... 2012-168193

(51) Int. Cl.
*E04B 1/19* (2006.01)
*E04B 1/24* (2006.01)
*E04C 3/04* (2006.01)

(52) U.S. Cl.
CPC ..... *E04B 1/1903* (2013.01); *E04B 1/2403* (2013.01); *E04C 3/04* (2013.01);
(Continued)

(58) Field of Classification Search
CPC . Y10T 403/443; Y10T 403/27; E04B 1/1903; E04B 1/1909; E04B 1/1927;
(Continued)

(56) References Cited

U.S. PATENT DOCUMENTS 3,507,526 A * 4/1970 Hubert ..... E04B 1/19 403/173
3,864,049 A * 2/1975 Ono ..... E02B 3/06 403/171
5,498,094 A 3/1996 Imai

FOREIGN PATENT DOCUMENTS

EP 2722538 A1 * 4/2014 ..... F16C 11/045
GB 2248862 A 4/1992
(Continued)

OTHER PUBLICATIONS

International Search Report for PCT/JP2013/070549, dated Oct. 29, 2013, 4 pages.

*Primary Examiner* — Jonathan Masinick
(74) *Attorney, Agent, or Firm* — Ware, Fressola, Maguire & Barber LLP

(57) ABSTRACT

A pin joint type structural member, made of double steel pipe consisting of a main pipe and a stiffening pipe, restrains buckling so as to be stable under axial compressive force. A clearance between the stiffening pipe 2 and the reinforcing member is determined so that a ratio ($P_{c2}/P_{c2}$) of the reinforcing member contact force with the stiffening pipe inner surface at the end 4*b* of a counter-clevis side, to the reinforcing member contact force with the stiffening pipe inner surface at the end 4*a* of the clevis side may be 0.40 to 0.65 when the reinforcing member 4 inclines to the main
(Continued)

pipe 1 due to the axial force acting on the main pipe 1. In addition, a length $L_{in}$ that the stiffening pipe 2 overlaps with the reinforcing member 4 is at least 1.1 times as large as the reinforcing member outer diameter at the overlapping portion.

18 Claims, 6 Drawing Sheets

(52) U.S. Cl.
CPC ..... *E04B 2001/1927* (2013.01); *E04B 2001/1957* (2013.01); *E04C 2003/0413* (2013.01); *Y10T 403/27* (2015.01)

(58) Field of Classification Search
CPC ..... E04B 1/2403; E04B 1/2466; E04B 2001/2445; E04B 2001/2496
See application file for complete search history.

(56) References Cited

FOREIGN PATENT DOCUMENTS

| | | | |
|---|---|---|---|
| JP | H0693654 | A | 4/1994 |
| JP | 1996-68110 | A | 3/1996 |
| JP | H11-193570 | A | 7/1999 |
| JP | H11-193639 | A | 7/1999 |
| JP | 2001-207678 | A | 8/2001 |
| JP | 2006-037590 | A | 2/2006 |
| JP | 2007-186894 | A | 7/2007 |

* cited by examiner

PIN JOINT TYPE STRUCTURAL MEMBER MADE OF DOUBLE STEEL PIPE FOR RESTRAINING BUCKLING THEREOF

CROSS REFERENCE TO RELATED APPLICATIONS

This application is a National Stage of PCT International Patent application no. PCT/JP2013/070549, filed 30 Jul. 2013, claiming priority in Japanese Patent application no. 2012-168193, filed 30 Jul. 2012, the contents of these documents being incorporated herein by reference.

TECHNICAL FIELD

The present invention relates to a pin joint type structural member made of double steel pipe for restraining buckling thereof, more particularly, to a reinforcing member for increasing in buckling strength of the structural member in response to reinforcing the end of a main pipe for sustaining axial force of the structural member which consists of an inner main pipe equipped with pin support type clevises at both ends of the main pipe and an outer stiffening pipe encircling the inner main pipe for exerting bending resistance as well as the structural member which consists of an outer main pipe and an inner stiffening pipe.

BACKGROUND ART

The system for supporting a long structural member typically includes a pin joint type system in which a moment does not act on the supporting portion at each end of the structural member and a fixed joint type system in which a moment acts on the supporting portion. In the fixed joint type system a deflection angle at the end of the structure is generally zero, and in the pin joint type system it is never zero. These phenomena are observed both in an inner pipe of a double pipe structure consisting of a main pipe for sustaining axial force and a stiffening pipe encircling the main pipe and in an outer pipe of a double pipe structure consisting of a main pipe and a stiffening pipe encircled by the main pipe. An example of the double steel pipe consisting of an outer main pipe and an inner stiffening pipe is disclosed in JP1992-149345A1.

It is necessary that a double steel pipe structural member for restraining buckling thereof does not buckle to be stable under the axial compression. The Official Guide for Steel Structure Buckling Design regulates several conditions in order not to buckle a structural member, e.g. "Preventing the ends of a structural member from being damaged" in relation to the present invention, thus a reinforcing member of a mouth piece type or a core metal type mentioned after has been introduced into the structural member.

A structural member made of double steel pipe is described hereinafter by giving an example in which the structural member is applied as a diagonal brace to a grid of the framework consisting of columns and beams. The right and left columns of the framework are loaded with lateral forces under an earthquake to lean in any direction, then the upper beam moves in the lateral direction relative to the lower beam. The framework deforms alternately to a parallelogram and to a parallelogram of the reverse shape while axial compressive force and axial tensile force act on the brace by turns, the brace made of a double pipe is loaded through only the main pipe, but is not loaded through the stiffening pipe which is supported at only one point so as not to fall out of the structural member. It is necessary for the stiffening pipe to have the bending resistance properties for preventing the main pipe from buckling and as such, has to remain straight.

The axis at the end of a pin support type main pipe for sustaining axial force always intersects the axis of the stiffening pipe, which is clearly different from the non-intersectional configuration in a cruciform plate joint type pipe, shown in JP2007-186894A1, fixedly supported at its both ends. When the stiffening pipe is an outer pipe, the larger the main pipe deforms, the closer the end of the main pipe comes towards the inner surface of the stiffening pipe. If the clearance between the main pipe and the stiffening pipe is small, even a slight flexure of the main pipe makes the end of the main pipe contact with the inner surface of the stiffening pipe. When the main pipe deforms heavily, a reaction force from the stiffening pipe causes deformation of the end of the main pipe, or a compressive force from the end of the main pipe causes deformation of the stiffening pipe.

In order to introduce a double pipe into a framework by using a pin joint, a clevis joint is available as shown in JP2009-193639A1. Engaging each clevis with a mouth piece by a right hand helix and left hand helix allows the length of the main pipe, namely, the distance between the eyes of both clevises, to be minutely controllable in proportion as the distance between both pins specified in a framework. A suitable over engagement of the helices permits the main pipe to be desirably pre-stressed.

A steel pipe is applied to a stiffening pipe so as to easily restrain the main pipe for sustaining axial force from bending. But the main pipe is sometimes damaged at the end thereof before the stiffening effect generated by the stiffening pipe appears. In order to avoid the damages of the main pipe and the deformation of the structural member, a cylindrical reinforcing member is fixed to the end of the main pipe. When the stiffening pipe is used as an inner pipe, a core metal to be inserted into the opening of the end of the stiffening pipe is integrated with the counter-clevis side of the mouth piece fixed to the end of the main pipe.

In the case where the stiffening pipe is an outer pipe and the reinforcing member is fixed to the end of the inner pipe (see JP1996-68110A1), the clearance between the reinforcing pipe and the stiffening pipe has to be large enough so that the inner pipe with the reinforcing pipe can be inserted into the outer pipe. When the stiffening pipe is an inner pipe and the reinforcing member is fixed to the end of the outer pipe (see JP1994-93654A1), the clearance between the stiffening pipe and the core metal used as the reinforcing member has to be large enough so that the core metal can be inserted into the inner pipe.

If the clearance mentioned above is excessively large, the stiffening pipe cannot function as a bending resistance pipe while the main pipe does not contact with the stiffening pipe in spite of the fact that the main pipe has already bent. The longer the reinforcing member and the core metal are, the more buckling restriction effect is improved. However, over-length of the reinforcing pipe or the core metal results in increasing in the weight of the structure member, over-shortage of them results in decreasing in buckling restriction effect generated by the stiffening pipe.

DOCUMENTS OF PRIOR ART

Patent Documents

Patent Document 1: JP1992-149345A1
Patent Document 2: JP2007-186894A1

Patent Document 3: JP2009-193639A1
Patent Document 4: JP1996-68110A1
Patent Document 5: JP1994-93654A1

DISCLOSURE OF INVENTION

Problems to be Solved

As shown in the above, the stiffening pipe has to encircle the reinforcing member with keeping a suitable clearance left. The main pipe for sustaining axial force shrinks under an axial compressive force, furthermore, buckles under the stronger compressive force, therefore, the reinforcing member widens to crack the opening of the stiffening pipe. The sudden decrease of the bending resistance caused by the stiffening pipe and the increase of the rotational angle of the reinforcing member, that is, a large inclination of the reinforcing member against the main pipe, causes the stiffening pipe to lose the function for restraining buckling.

Quantitative study has not been pursued for the clearance between the stiffening pipe and the reinforcing member, e.g. a reinforcing pipe as a mouth piece or the core metal integrated with the mouth piece and for the length of the reinforcing member. Currently design engineers have properly determined the clearance through their technical experience and perception, this involves the alternative of estimating the allowable strength of the main pipe to be low or of selecting the sizes applied to a member and/or its parts larger in anticipation of safety. Unfortunately the behavior of the stiffening member under the buckling restriction of the main pipe has not been proved. It is important to establish criteria for avoiding the bend of the end of main pipe based on precise analyses so as to realize reliable structural members.

The object of the present invention is to solve the problems outlined above by proposing a pin joint type structural member made of double steel pipe for restraining buckling, particularly, to realize the double steel pipe structural member whose main pipe for sustaining axial force exhibits a stable behavior even when the main pipe is loaded with the force over its yield strength by means of restraining the double steel pipe, consisting of a main pipe and a stiffening pipe, from buckling under the axial compressive force.

DETAILED DESCRIPTION OF THE INVENTION

Figure 1:
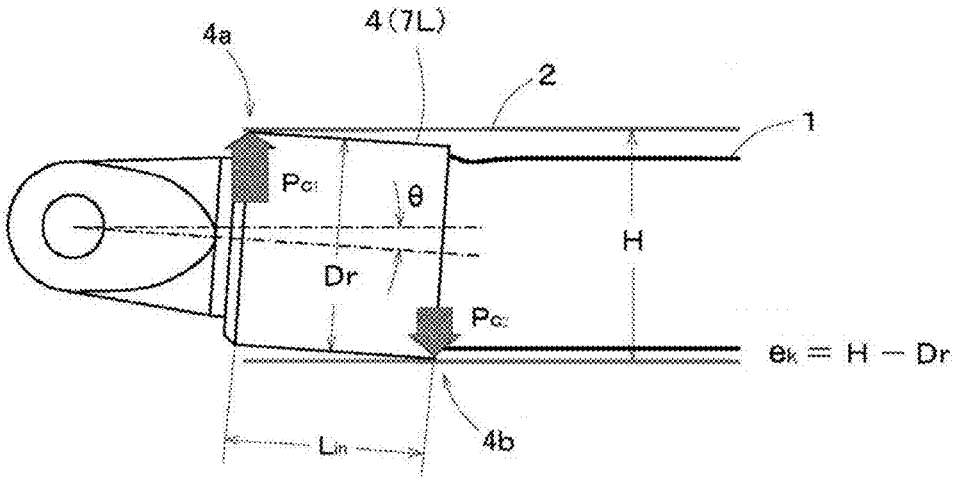
FIG. 1 is an illustration of the principal part of a structural member made of double steel pipe according to the present invention, showing contact forces with the inner surface of the stiffening pipe at the end of clevis side and at the end of counter-clevis side.

The present invention is applied to a structural member made of double steel pipe; provided with a main pipe for sustaining axial force to which a reinforcing member is coaxially fixed at one end of the main pipe in order to prevent the end of the main pipe from deforming while axial compressive force acts on the structural member, a stiffening pipe forming a double steel pipe with the main pipe and encircling the main pipe including the reinforcing member in order to prevent a bend of the main pipe from increasing and being displaceable in the axial direction relative to the main pipe, and pin support type clevises equipped at both ends of the main pipe. The characteristic of the invention, referring to FIG. 1, is provided with a clearance $e_k$ between the stiffening pipe 2 and the reinforcing member 4 being determined so that a ratio ($P_{c2}/P_{c1}$) of the contact force $P_{c2}$ of the reinforcing member with the inner surface of stiffening pipe at the end 4*b* of counter-clevis side to the contact force $P_{c1}$ of the reinforcing member with the inner surface of stiffening pipe at the end 4*a* of clevis side may be 0.40 to 0.65 when the reinforcing member 4 inclines to the main pipe 1 due to the axial force acting on the main pipe 1, and a length $L_{in}$ that the stiffening pipe 2 overlaps with the reinforcing member 4 being determined so as to be at least 1.1 times as large as the outer diameter $D_r$ of the reinforcing member at the overlapping portion.

The reinforcing member is the reinforcing pipe 4 fixed to the inner pipe of the double steel pipe as a cylindrical mouth piece 7L of a large thickness, and the stiffening pipe 2 is a cylindrical outer pipe of a small thickness encircling the reinforcing pipe 4.

Figure 7:
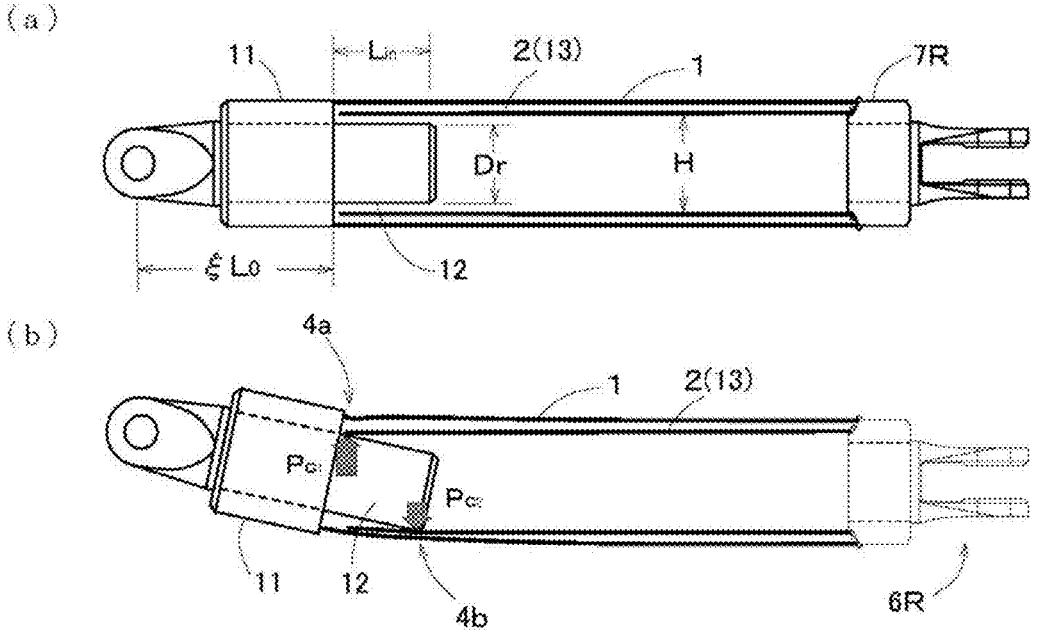
FIG. 7*a* is a internal structural illustration of a structural member made of double steel pipe whose inner pipe is a stiffening pipe and FIG. 7*b* is an illustration showing the deformation of the structural member; and, FIGS. 8*a* and 8*b* are illustrations of the reinforcement around the opening of the stiffening pipe with which the reinforcing member overlaps.

Referring to FIG. 7, the reinforcing member may be a core metal 12 having a small diameter and extending axially at the counter-clevis side of the cylindrical mouth piece 11 of a large thickness which is fixed to an outer pipe of the double steel pipe, and the stiffening pipe 2 results to be a cylindrical inner pipe 13 of a small thickness encircling the core metal.

Figure 8:
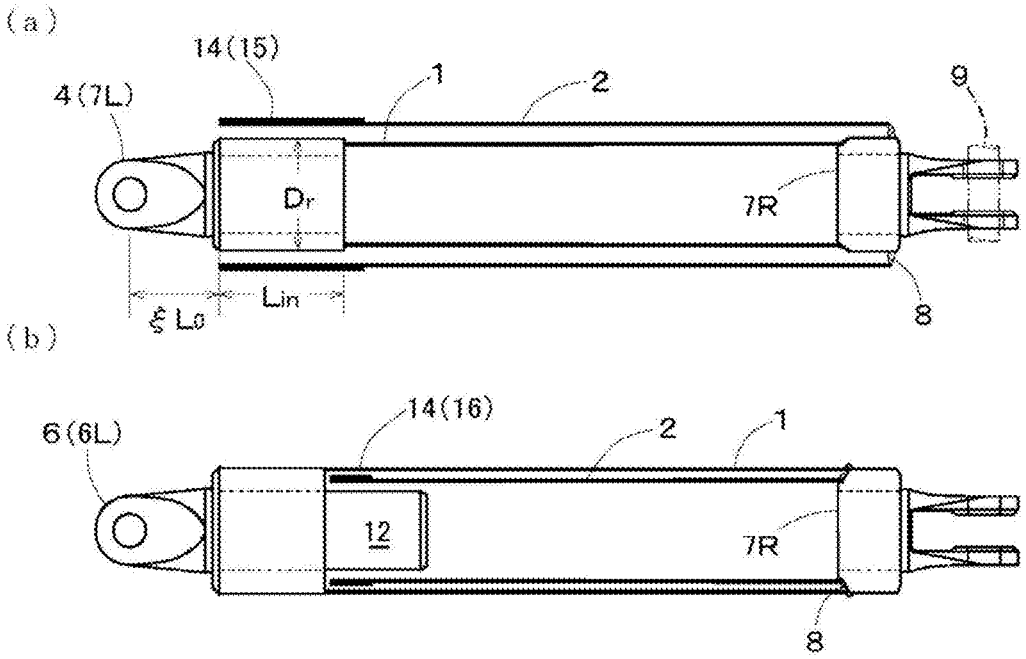

The main pipe 1 for sustaining axial force is 100 to 500 millimeters in outer diameter, the length that the stiffening pipe 2 overlaps the reinforcing member is determined to be 1.2 to 1.6 times as large as the outer diameter of the reinforcing member at the overlapping portion. A ratio ek/Lin of the clearance between the stiffening pipe 2 and the reinforcing member at the overlapping portion of the stiffening pipe 2 with the reinforcing member to a length of the overlapping portion of the reinforcing member with the stiffening pipe is determined to be 0.01 to 0.02 when the main pipe 1 made of ordinary steel. In the case of the main pipe 1 made of low yield point steel, the ratio is determined to be 0.005 to 0.01. As known in the art, in contrast to ordinary steel, low yield point steel has a composition that is nearly pure iron with negligible carbon and alloy elements and having lower tensile strength with lower and narrowerrange yield points. As shown in FIG. 8, it is preferable to form a thick circular part 14 at the portion where the stiffening pipe 2 overlaps with at least the reinforcing member 4.

Effect of Invention

According to the present invention, when the reinforcing member inclines to the main pipe for sustaining axial force, the clearance between the stiffening pipe and the reinforcing member is determined so that the ratio of the contact force of the reinforcing member with the inner surface of stiffening pipe at the end of the counter-clevis side to the contact force of that at the end of clevis side may be 0.40 to 0.65, and the length that the stiffening member overlaps with the reinforcing member is determined so as to be at least 1.1 times as large as the outer diameter of the reinforcing member at the overlapping portion, thereby, the design axial force of the structural member made of double steel pipe is allowable over 1.3 times as large as the yield axial force of the main pipe.

When the reinforcing member is a cylindrical mouth piece of a large thickness fixed to the inner pipe of the double pipe, the stiffening pipe is a cylindrical outer pipe of a small thickness encircling the mouth piece. When the reinforcing member is a core metal with a small diameter which extends axially at the counter-clevis side of a cylindrical mouth piece of a large thickness fixed to the outer pipe of the double steel pipe, the stiffening pipe is a cylindrical inner pipe of a small thickness encircling the core metal.

The main pipe for sustaining axial force being 100 to 500 millimeters in outer diameter, the length that the stiffening pipe overlaps with the reinforcing member being 1.2 to 1.6 times as large as the outer diameter of the reinforcing member at the overlapping portion, make it possible to prevent an inclination of the reinforcing member at an early stage and a lengthening of the reinforcing member which causes an increase in weight.

The ratio ($e_k/L_{in}$) of the clearance between the reinforcing member and the stiffening pipe at the portion that the stiffening pipe overlaps with the reinforcing member to the length of the portion that the stiffening pipe overlaps with the reinforcing member being 0.01 to 0.02, can be applied to a main pipe made of ordinary steel. The ratio of that being 0.005 to 0.01 can be applied to a main pipe made of low yield point steel.

Providing a thick circular part at the portion that the stiffening pipe overlaps with at least the reinforcing member, leads to an increase in stiffness of the structural member due to the stiffening pipe.

Figure 2:
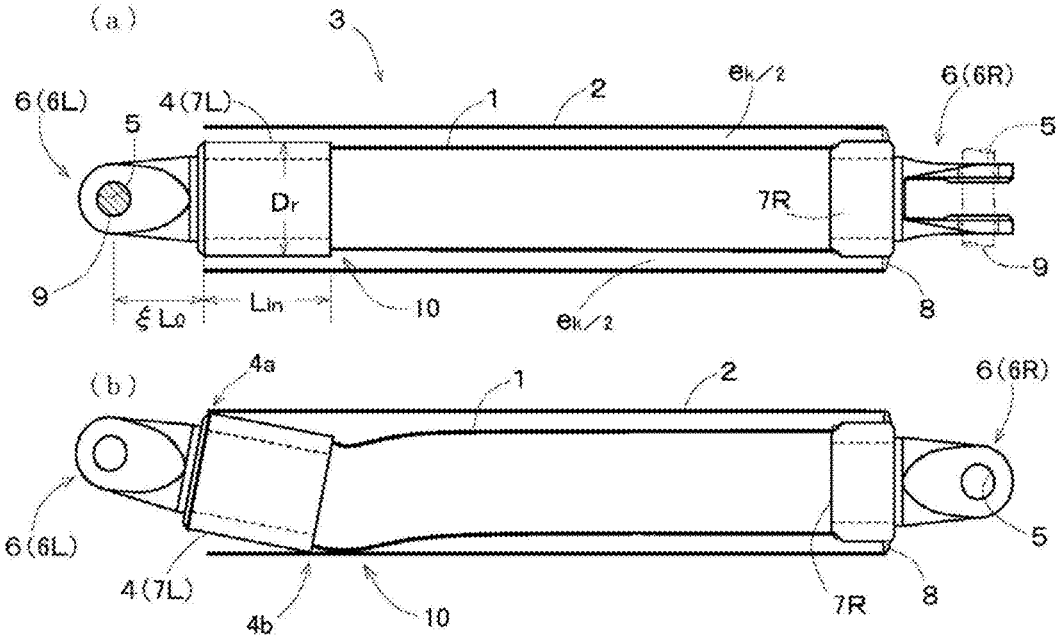
FIG. 2*a* is an illustration of an original structural member and FIG. 2*b* is an illustration of a structural member in which the reinforcing pipe bends at the end of the main pipe inside the stiffening pipe.
Figure 3:
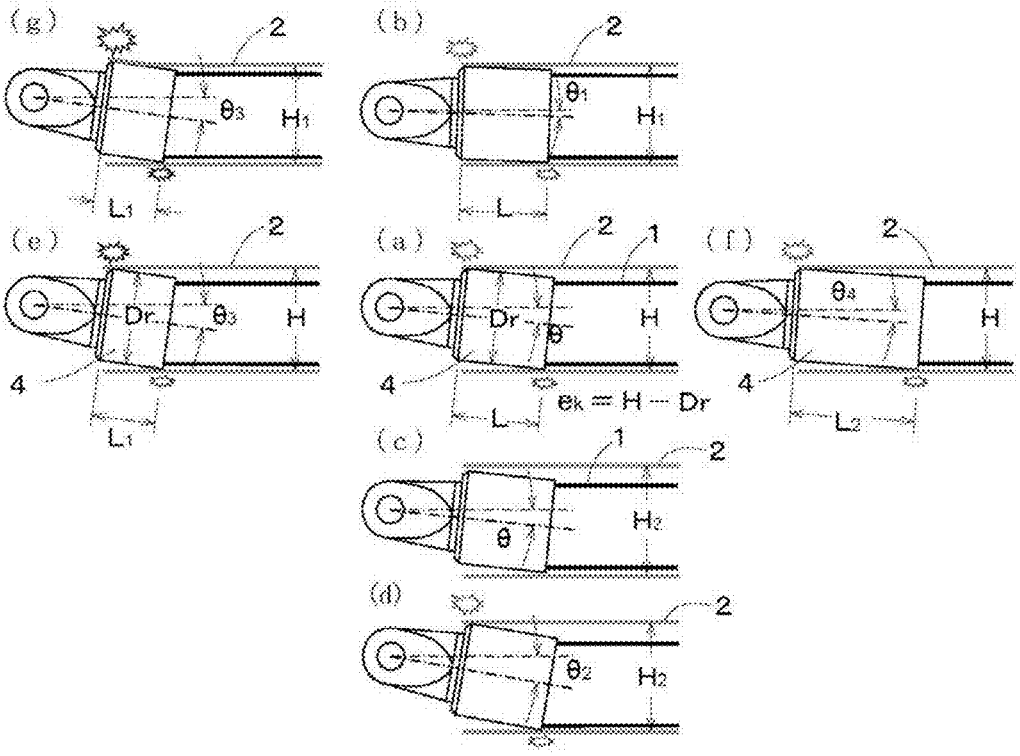
FIGS. 3*a*, 3*b*, 3*c*, 3*d*, 3*e*, 3*f* and 3*g* are qualitative illustrations showing different deformations in response to changes in the length of the reinforcing pipe and to the size of the clearance in the double pipe.

The pin joint type structural member made of double steel pipe for restraining buckling according to the present invention is disclosed by referring to the drawings. The embodiment of the structural member is a double steel pipe 3 of pin joining type, consisting of a main pipe 1 for sustaining axial force used as an inner pipe and a stiffening pipe 2 as an outer pipe, as shown in FIG. 2(*a*) where the structural member is drawn shorter than it actually is for easy understanding.

More particularly, a reinforcing pipe 4, which prevents the main pipe 1 for sustaining axial force from buckling while axial compressive force acts on the main pipe, is coaxially fixed to an end of the main pipe. The stiffening pipe 2 encircles the reinforcing pipe 4 along its axis, preventing the main pipe 1 from increasing in bending, and being displaceable in the axial direction relative to the reinforcing pipe 4. The main pipe 1 is made of a steel pipe of a small thickness, the reinforcing pipe 4 is made of a pipe of a large thickness is so rigid that the deformation of the reinforcing pipe is always negligibly small in comparison with that of the main pipe. The stiffening pipe 2 is a steel pipe of a small thickness which is favorable as it is lighter, because the ratio of the outer diameter of the pipe to the thickness of the pipe is much larger.

The main pipe 1 for sustaining axial force is provided with clevises 6 having joining eyes 5 for pin-supporting at both ends of the main pipe. The clevises are engaged with the mouth pieces 7L and 7R by using a left hand helix and a right hand helix respectively, the distance between the joining eyes of both clevises can be minutely adjustable as a turnbuckle does in response to the pitch of holes for pin-joining on the framework. The stiffening pipe 2 mentioned above is welded to the mouth piece 7R only by forming a peripheral bead 8 and as such, does not receive axial force, being always free from bending accordingly. The clevis 6L of the left side in the figure shows a front view, and the clevis 6R of the right side shows a plan view. The numeral 9 shows a joining pin.

The stiffening pipe 2 is fixed to the mouth piece 7R by welding, but is free from the mouth piece 7L. Thus local buckling early occurs at the side to which the stiffening pipe is not fixed when axial force acts on the structural member, as shown in the left part of FIG. 2(*b*). The reinforcing pipe 4 mentioned above is used as the mouth piece 7L for preventing the local buckling.

Behavior of the structural member made of double pipe 3 is qualitatively described below. While the main pipe 1 for sustaining axial force is under the axial compressive force which does not exceed the yield axial force thereof, the main pipe only shrinks elastically inside the stiffening pipe 2. If the axial compressive force exceeds the yield axial force, the main pipe buckles to be bent. A portion to be damaged or deformed is one end of the main pipe, thus the reinforcing pipe 4 mentioned above is fixed to the main pipe by welding in order to reinforce the portion. With consequence of applying much more rigid material to the reinforcing pipe 4 than to the main pipe 1, the reinforcing pipe deforms scarcely. The portion deformed under compressive force which exceeds the yield axial force is a connecting portion 10 that the stiffening pipe 4 is fixed to the main pipe 1. If the connecting portion is bent, the reinforcing pipe 4 inclines as shown in FIG. 2(*b*) where the bent is exaggeratedly shown. When the end 4*a* of the clevis side or the end 4*b* of the counter-clevis side of the reinforcing pipe 4 contacts with the inner surface of the stiffening pipe 2, the stiffening pipe 2 prevents the reinforcing pipe 4 from further inclining and the main pipe 1 from further deforming.

Referring to FIGS. 3*a* through 3*g*, on the basis of (a), when a difference between the inner diameter H of the stiffening pipe 2 and the outer diameter $D_r$ of the reinforcing pipe 4, i.e. the clearance $e_k$, is small like a difference in (b), i.e. $H_1<H$, the stiffness due to the stiffening pipe 2 will be effective early. When the clearance is large like the clearance shown in (c) and (d), i.e. $H<H_2$, the stiffness due to the stiffening pipe 2 will be ineffective or be effective lately. When the reinforcing pipe 4 is short, i.e. $L_1<L$, the reinforcing pipe severely bends as shown in (e). When the reinforcing pipe is long as shown in (f), i.e. $L<L_2$, the reinforcing pipe increases in weight though it is advantageous for the reinforcing pipe to only slightly bent due to the stiffness while the inclination θ of the reinforcing pipe remains less than $\theta_4$. (g) shows the state that a large inclination of the reinforcing member 4 deforms to widen the end of the stiffening pipe.

The main pipe 1 for sustaining axial force and the stiffening pipe 2 of the structure member made of double steel pipe are, in general, 100 to 500 mm in outer diameter, and 3,500 to 5,500 mm in length, and 6 to 16 mm in thickness. With applying such sizes to models and 4 to 25 millimeters to their clearances between the stiffening pipe 2 and the reinforcing pipe 4, some models of pin joint type structural member made of double steel pipe have been analyzed by Finite Element Method for searching the requirements to keep the structural member stable even if the design axial force of the structural member made of double steel pipe is over 1.3 times as large as the yield axial force of the main pipe.

Referring to FIG. 1, the analysis mentioned above has shown that it is essential to determine a clearance $e_k$ between the stiffening pipe 2 and the reinforcing pipe 4 so as to satisfy the condition that the ratio $P_{c2}/P_{c1}$ of the contact force $P_{c2}$ with the inner surface of the stiffening pipe at the end 4*b* of counter-clevis side of the reinforcing member 4 to the contact force $P_{c1}$ with the inner surface of the stiffening pipe at the end 4*a* of clevis side of the reinforcing member is within a range of 0.40 to 0.65. The longer the length that the stiffening pipe 2 overlaps with the reinforcing pipe 4 is, i.e. the longer the length $L_{in}$ of insertion of the reinforcing pipe 4 into the stiffening pipe 2 is, the lower the ratio of $P_{c2}$ to $P_{c1}$ is. When the $P_{c1}$ is higher than $P_{c2}$, the outer pipe (the stiffening pipe) is severely deformed at the end thereof. Increasing in the contact surface as $P_{c2}/P_{c1}$ is close to 0.6, for instance, possibly promotes the strength of the main pipe. The analysis mentioned above has also shown that it is essential for the length $L_{in}$ of insertion to be at least 1.1 times as large as the outer diameter of the overlapping portion of the reinforcing pipe 4, where the outer diameter of the overlapping portion means just an outer diameter of itself when the reinforcing pipe is uniform in diameter, or the outer diameter of the overlapping portion means an outer diameter of the portion encircled by the stiffening pipe when the reinforcing pipe is not uniform in diameter, i.e. consisting of an undrawn portion of a large diameter out of the stiffening pipe and a portion of a small diameter in the stiffening pipe.

The further analysis has confirmed that a length $L_{in}$ of insertion of 1.2 times as large as the outer diameter of the reinforcing pipe makes it possible for the strength of the structural member made of double steel pipe to exceed 1.3 times as large as the yield axial force of the main pipe 1 for sustaining axial force, and 1.6 times at maximum. Using such length of insertion leads to preventing the reinforcing pipe from excessively increasing in length and weight. When the main pipe is made of ordinary steel, the ratio of the clearance $e_k$, between the stiffening pipe 2 and the reinforcing pipe 4 at the portion that the reinforcing pipe 4 overlaps with the stiffening pipe 2, to the length $L_{in}$ that the reinforcing pipe 4 overlaps with the stiffening pipe, is determined to be 0.01 to 0.02, thereby the endurance may be sufficient. When the main pipe is made of low yield point steel, the ratio being 0.005 to 0.01 makes the strength remarkably improved.

In other words, the clearance $e_k$ is determined so as to make an angle θ of 0.57 to 1.15 degrees of inclination of the reinforcing pipe for the case of ordinal steel, and $e_k$ is determined so as to make an angle θ of 0.29 to 0.57 degrees for the case of low yield point steel. For the case of ordinal steel, the length $L_{in}$ of insertion is supposed to be 250 millimeters, $e_k$ shall be 2.5 to 5.0 millimeters. The clearance necessary for inserting an inner pipe into an outer pipe is supposed to be 4 millimeters, the length of insertion is determined so that $e_k$ may be between 4 and 5 millimeters. When the length $L_{in}$ of insertion is 350 millimeters, the clearance $e_k$ necessary for inserting an inner pipe into an outer pipe shall be 3.5 to 7.0 millimeters, thus the length of insertion is determined so that $e_k$ may be between 4 to 7 millimeters. The ratio of $e_k/L_{in}$ for low yield point steel is about a half of that for ordinal steel, this is probably due to occurrence of reinforcing action in early stage because the low yield point steel tends to have a big buckling.

If the numerical values does not fill the requirement mentioned above, the ratio of the contact force of the reinforcing pipe 4 with the inner surface of stiffening pipe at the end of counter-clevis side to the contact force of the reinforcing pipe with the inner surface of stiffening pipe at the end of clevis side is outside the range of 0.40 to 0.65. This results in that the strength to be over 1.3 times as large as the yield axial force of the main pipe is not stably kept as a design axial force of the structural member made of double steel pipe.

Figure 4:
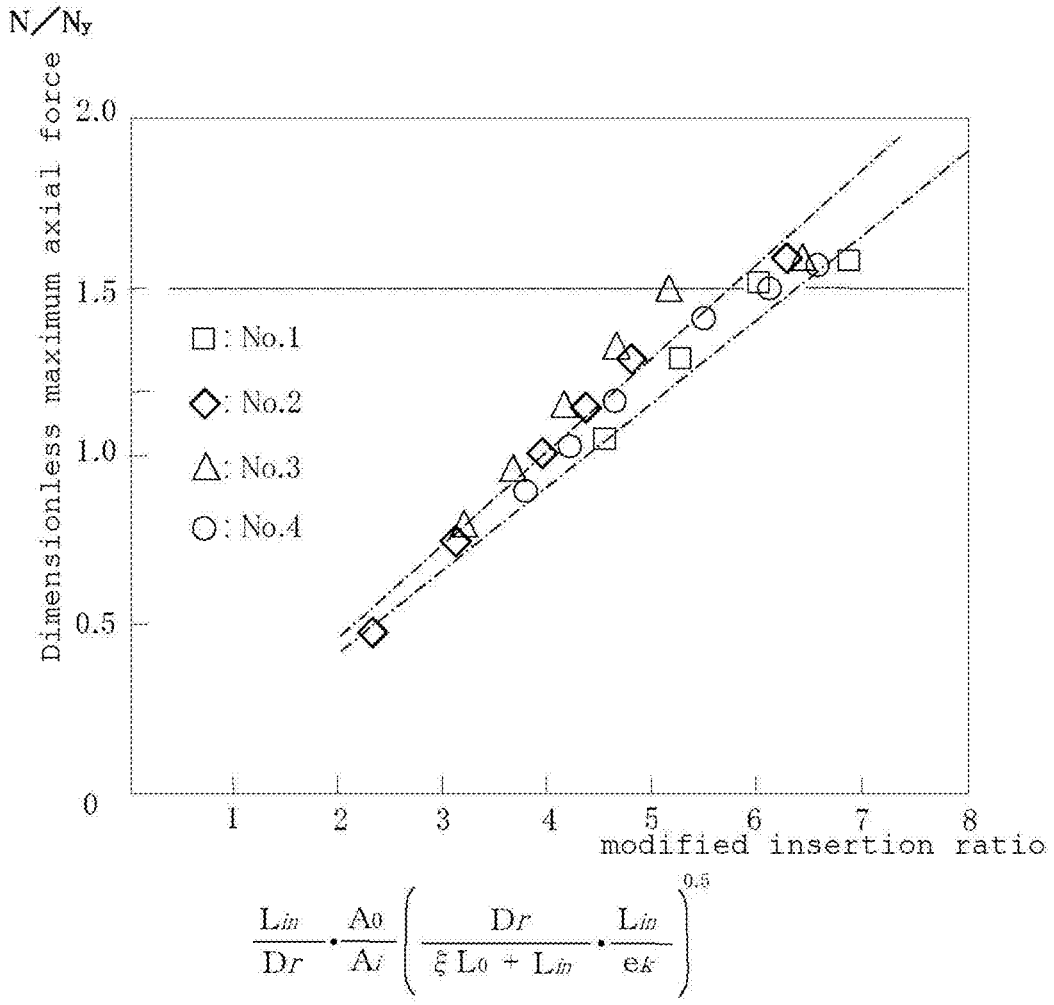
FIG. 4 is a graph showing a calculation result of dimensionless maximum axial force for the modified length of insertion.

The analysis provides calculations of both an insertion ratio (a value that a length of insertion is divided by an outer diameter of a reinforcing pipe: $L_{in}/D_r$) and a dimensionless maximum axial force (a value that a critical buckling strength of a double pipe is divided by a yield axial force of an inner pipe: $N/N_y$). Because the analysis depends on the dimensions of the structural elements, a modified insertion ratio, a product of the ratio of length of insertion and a ratio $A_o/A_i$ of area of cross section that area of cross section of the outer pipe is divided by that of the inner pipe, has been introduced into the calculation in order to improve the correlation with the structural elements, as shown in FIG. 4. The dimensionless maximum axial force is expressed by the equation (1) as follows. The signs of No. 1, No. 2, etc. in the graph indicate numbers of samples of double pipe.

Formula 1

$$N_{max}/N_y=(L_{in}/D_r)\cdot(A_o/A_i)\cdot[(D_r/(\xi L_o+L_{in}))\cdot(L_{in}/e_k)]^{0.5} \quad (1)$$

where $\xi L_o$ is the distance between the end of the reinforcing pipe and the center of the clevis eye.

The equation can be used in determining the specifications of the structural member made of double steel pipe in which to prevent the main pipe for sustaining axial force from buckling owing to the stiffening pipe without increasing the thickness of the main pipe and to prevent the structural member from increasing the weight by applying a pipe of a small thickness to the stiffening pipe. The equation shows that the structural member made of double steel pipe keeps elastic without deforming both the end of the main pipe and the end of stiffening pipe even in a range that is greatly beyond the yield strength of the main pipe for sustaining axial force. This means that $P_{c2}/P_{c1}$ keeps between 0.40 and 0.65 as far as the equation (1) is satisfied, and the design axial force is guaranteed to be over 1.3 times as large as the yield axial force of the main pipe for sustaining axial force.

Figure 5:
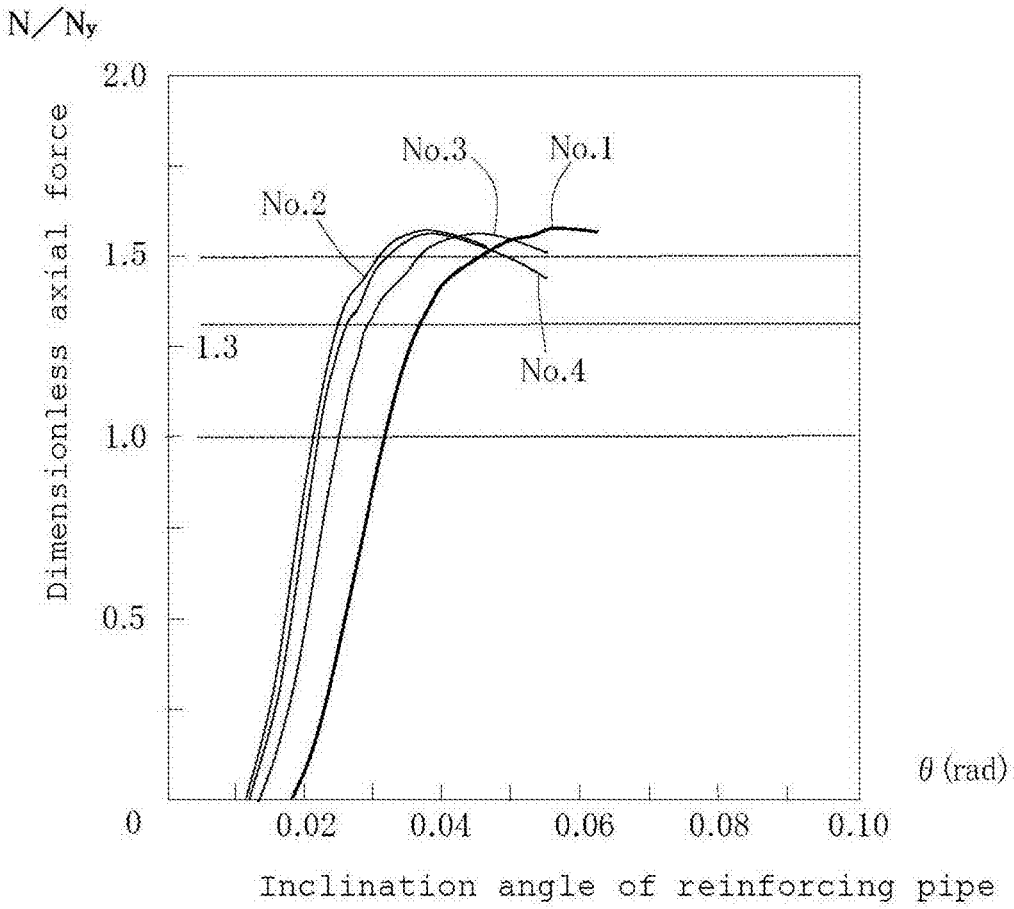
FIG. 5 is a graph showing a calculation result in which axial force for designing a structural member made of double steel pipe is over 1.3 times as large as the yield axial force of the main pipe.
Figure 6:
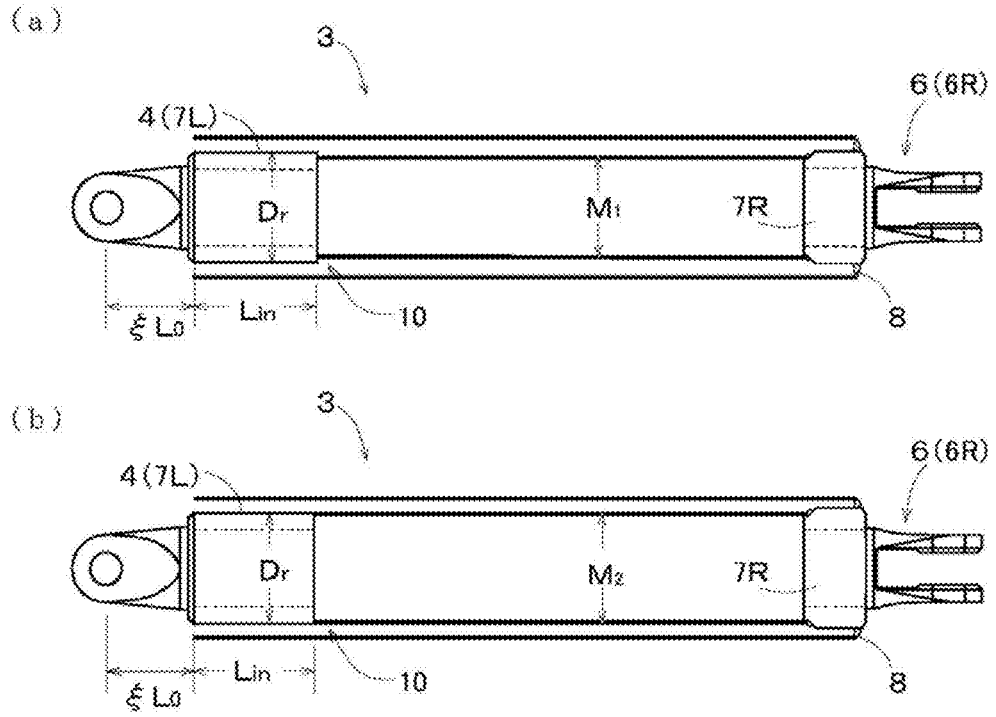
FIGS. 6*a* and 6*b* are structural illustrations of two examples in which the outer diameter of the main pipe is different from and equal to the outer diameter of the reinforcing pipe.

FIG. 5 indicates the change in the dimensionless axial force for the angles θ of inclination of the reinforcing pipe 4, showing samples of calculation that the design axial force of structural member made of double steel pipe exceeds 1.3 times as large as the yield axial force of the main pipe 1 for sustaining axial force. The sizes of the sample corresponding to each number in FIG. 4 and FIG. 5 are omitted. In FIG. 1 etc. the outer diameter of the reinforcing pipe 4 is drawn larger than that of the main pipe 1, but the equation mentioned above is also applicable to the case that the outer diameter of the reinforcing main pipe 4 is the same as that of the main pipe 1 as FIG. 6(*b*) drawn by comparison with FIG. 6(*a*) which is corresponding to FIG. 2(*a*). Thus the determination of the outer diameter M of the main pipe does not depend on the outer diameter of the reinforcing pipe 4 under the condition that the outer diameter of the main pipe is not larger than $M_2$.

In the embodiment mentioned above, the reinforcing pipe 4 is a reinforcing member which is a cylindrical mouth piece 7L of a large thickness fixed to the inner pipe of the double pipe, and the stiffening pipe 2 is a cylindrical outer pipe of a small thickness encircling the whole of the mouth piece 7L. The present invention is applicable not only to the configuration mentioned above, but to another configuration shown in FIG. 7(*a*) in which a reinforcing member is a core metal 12 with a small diameter extending in the axial direction at the end of counter-clevis side of a cylindrical mouth piece 11 of a large thickness fixed to a main pipe 1 for sustaining axial force as an outer pipe of the double steel pipe, and the stiffening pipe 2 is a cylindrical inner pipe 13 encircling the greater part of the core metal 12.

The core metal 12 and the cylindrical pipe 13 correspond to the reinforcing pipe 4 and stiffening pipe 2 of the former case, respectively. Inclination of the core metal corresponds to the inclination of the mouth piece of the former case. $\Xi L_o$ in the equation (1) is the distance from the base of the core metal 12 to the center of the clevis eye. $e_k$ mentioned above is also applicable to the clearance between a cylindrical pipe 13 and a core metal 12 in FIG. 7(*b*), corresponding to the ratio of the contact force $P_{c2}$ with the inner surface of the stiffening pipe at the end 4*b* of the counter-clevis side of the core metal 12 to the contact force $P_{c1}$ with the inner surface of the stiffening pipe at the end 4*a* of the clevis side may be 0.40 to 0.65. In addition, it is essential for the length $L_{in}$ of insertion to be at least 1.1 times as large as the outer diameter of the overlapping portion of the core metal with the cylindrical pipe 13.

As shown in FIG. 8(*a*), a stiffening pipe 2 may be also provided with a thick circular part 14 at or near the opening of the portion where it overlaps with at least the reinforcing pipe 4. The stiffening pipe itself is reinforced, thereby, absolute values of the contact forces $P_{c1}$ and $P_{c2}$ with the inner surface of stiffening pipe, mentioned above, can be increased. The thick circular part can be established by using a thick stiffening pipe (not shown) or preferably by encircling the end of the stiffening pipe 2 with a thin pipe 15 for hooping. A circular part applied to a double steel pipe is shown in FIG. 8(*b*) where a core metal 12 is used for a reinforcing member and a ring 16 is drawn to be shorter than the length of the overlapping portion.

Both FIG. 1 and FIG. 7 show the long structural member made of double steel pipe which is provided with the main pipe 1 for sustaining axial force to which the reinforcing member 4 or 12 is coaxially fixed in order to prevent the end of the main pipe from deforming while axial compressive force acts on the structural member, the stiffening pipe 2 forming the double steel pipe with the main pipe and encircling the main pipe including the reinforcing member in order to prevent a bend of the main pipe from increasing and being displaceable in the axial direction relative to the main pipe, and the pin-support type clevises equipped at both the ends of the main pipe. The present invention is applicable to every case mentioned above, thereby "Preventing the ends of a structural member from being damaged", which is regulated in Official Guide for Steel Structure Buckling Design, can be realized even in the structural member made of double steel pipe.

BRIEF DESCRIPTION OF SYMBOLS

1: main pipe for sustaining axial force, 2: stiffening pipe, 3: double pipe, 4: reinforcing member (reinforcing pipe), 4*a*: end of clevis side of reinforce member, 4*b*: end of counter-clevis side of reinforce member, 6L: clevis, 6R: clevis, 7L: mouth piece, 7R: mouth piece, 11: cylindrical mouth piece, 12: reinforcing member (core metal), 13: cylindrical pipe, $e_k$: clearance, θ: inclination of reinforcing pipe (reinforcing member), $P_{c1}$: contact force with the inner surface of stiffening pipe at the end of clevis side, $P_{c2}$: contact force with the inner surface of stiffening pipe at the end of counter-clevis side, $L_{in}$: length of insertion (overlap length of reinforcing pipe and stiffening pipe, $D_r$: outer diameter of reinforcing pipe, $A_o/A_i$: ratio of area of cross section of outer pipe to area of cross section of inner pipe, $N_{max}/N_y$: dimensionless maximum axial force (a value that a critical buckling strength of a double pipe is divided by a yield axial force of an inner pipe).

The invention claimed is:

1. A pin joint type structural member made of a double steel pipe comprising:

a main pipe for sustaining an axial force, and a reinforcing member coaxially fixed to a first end of the main pipe to prevent the first end of the main pipe from deforming when an axial compressive force acts on the structural member;

a stiffening pipe for forming a double steel pipe with the main pipe, the stiffening pipe encircling the main pipe including the reinforcing member to prevent a bend of the main pipe from increasing and being displaceable in an axial direction relative to the main pipe; and pin support type devises located at each end of the main pipe;

wherein a clearance between the stiffening pipe and the reinforcing member has a ratio of a contact force of the reinforcing member with an inner surface of the stiffening pipe at an end at a counter-clevis side thereof, to a contact force of the reinforcing member with the inner surface of stiffening pipe at an end at the clevis side thereof is between 0.40 to 0.65 when the reinforcing member inclines to the main pipe due to the axial force acting on the main pipe, and a length that the stiffening pipe overlaps with the reinforcing member is 1.1 to 1.6 times as large as an outer diameter of the reinforcing member at an overlapping portion thereof.

2. The pin joint type structural member of claim 1, wherein:

the reinforcing member is a reinforcing pipe fixed to an inner surface of the stiffening pipe of the double steel pipe as a cylindrical mouth piece, the stiffening pipe being a cylindrical outer pipe for encircling the reinforcing pipe.

3. The pin joint type structural member of claim 2, wherein the stiffening pipe has a thickness between six to sixteen millimeters and the thickness of the cylindrical mouthpiece is greater than the thickness of the stiffening pipe.

4. The pin joint type structural member of claim 1, wherein:

the reinforcing member is a core metal and extending axially at the counter-clevis side of a cylindrical mouth piece which is fixed to the main pipe that is configured as an outer pipe of the double steel pipe encircling the stiffening pipe, and the stiffening pipe is a cylindrical inner pipe encircling the core metal.

5. The pin joint type structural member of claim 1, wherein:

the main pipe has an outer diameter of 100 to 500 millimeters, the overlap length being 1.2 to 1.6 times as large as the outer diameter of the reinforcing member at the overlapping portion.

6. The pin joint type structural member of claim 1, wherein:

the main pipe has an outer diameter of 100 to 500 millimeters, the clearance ratio at the overlapping portion being between 0.01 to 0.02 when the main pipe is made of ordinary steel that comprises a non-negligible amount of carbon.

7. The pin joint type structural member of claim 1, wherein:

the main pipe has an outer diameter of 100 to 500 millimeters, the clearance ratio being between 0.005 to 0.01 when the main pipe is made of a low yield point steel that is nearly pure iron in that the low yield point steel comprises no more than a negligible amount of carbon.

8. The pin joint type structural member of claim 1, wherein:

at least a part of the overlapping portion of the stiffening pipe that overlaps with the reinforcing member is thicker than at least a portion of the stiffening pipe that is not overlapping the reinforcing member.

9. The pin joint type structural member of claim 1, wherein the stiffening pipe is coaxially fixed and supported at only one point located at a second end of the main pipe and does not receive axial force exerted on the main pipe such that the stiffening pipe is axially displaceable relative to the main pipe.

10. A method of proportioning a pin joint type structural member made of a double steel pipe comprising:

a main pipe for sustaining an axial force, and a reinforcing member coaxially fixed to a first end of the main pipe to prevent the first end of the main pipe from deforming when an axial compressive force acts on the structural member;

a stiffening pipe for forming a double steel pipe with the main pipe, the stiffening pipe encircling the main pipe including the reinforcing member to prevent a bend of the main pipe from increasing wherein the stiffening pipe is displaceable in an axial direction relative to the reinforcing member; and pin support type devises located at each end of the main pipe;

wherein the method comprises:

selecting a clearance between the stiffening pipe and the reinforcing member to have a ratio of a contact force of the reinforcing member with an inner surface of the stiffening pipe at an end at a counter-clevis side thereof, to a contact force of the reinforcing member with the inner surface of stiffening pipe at an end at the clevis side thereof between 0.40 to 0.65 when the reinforcing member inclines to the main pipe due to the axial force acting on the main pipe, and selecting a length that the stiffening pipe overlaps with the reinforcing member that is 1.1 to 1.6 times as large as an outer diameter of the reinforcing member at an overlapping portion thereof.

11. The method of claim 10, wherein the reinforcing member is a reinforcing pipe fixed to an inner surface of the stiffening pipe of the double steel pipe as a cylindrical mouth piece, the stiffening pipe being a cylindrical outer pipe for encircling the reinforcing pipe.

12. The method of claim 11, wherein the stiffening pipe has a thickness between six to sixteen millimeters and the thickness of the cylindrical mouthpiece is greater than the thickness of the stiffening pipe.

13. The method of claim 10, wherein the reinforcing member is a core metal and extending axially at the counter-clevis side of a cylindrical mouth piece which is fixed to the main pipe that is configured as an outer pipe of the double steel pipe encircling the stiffening pipe, and the stiffening pipe is a cylindrical inner pipe encircling the core metal.

14. The method of claim 10, wherein the main pipe has an outer diameter of 100 to 500 millimeters, the overlap length being 1.2 to 1.6 times as large as the outer diameter of the reinforcing member at the overlapping portion.

15. The method of claim 10, wherein the main pipe has an outer diameter of 100 to 500 millimeters, the clearance ratio at the overlapping portion being between 0.01 to 0.02 when the main pipe is made of ordinary steel that comprises a non-negligible amount of carbon.

16. The method of claim 10, wherein the main pipe has an outer diameter of 100 to 500 millimeters, the clearance ratio being between 0.005 to 0.01 when the main pipe is made of a low yield point steel that is nearly pure iron in that the low yield point steel comprises no more than a negligible amount of carbon.

17. The method of claim 10, wherein at least a part of the overlapping portion of the stiffening pipe that overlaps with the reinforcing member is thicker than at least a portion of the stiffening pipe that is not overlapping the reinforcing member.

18. The method of claim 10, wherein the stiffening pipe is coaxially fixed and supported at only one point located at a second end of the main pipe and does not receive axial force exerted on the main pipe.

* * * * *